US007748927B2

(12) United States Patent
Neathery

(10) Patent No.: US 7,748,927 B2
(45) Date of Patent: Jul. 6, 2010

(54) MANHOLE INSERT AND TETHER LOCKING APPARATUS AND METHOD

(76) Inventor: David L. Neathery, 1830 Willow Point, Shreveport, LA (US) 71119

( * ) Notice: Subject to any disclaimer, the term of this patent is extended or adjusted under 35 U.S.C. 154(b) by 438 days.

(21) Appl. No.: 11/823,091

(22) Filed: Jun. 26, 2007

(65) Prior Publication Data

US 2008/0003056 A1 Jan. 3, 2008

Related U.S. Application Data

(60) Provisional application No. 60/818,429, filed on Jul. 3, 2006.

(51) Int. Cl.
*E02D 29/14* (2006.01)

(52) U.S. Cl. ..... 404/25; 52/19

(58) Field of Classification Search ..... 404/25, 404/26; 52/19, 20; 174/50.5
See application file for complete search history.

(56) References Cited

U.S. PATENT DOCUMENTS 4,373,381 A * 2/1983 Kulp et al. ..... 73/40.5 R
4,650,365 A * 3/1987 Runnels ..... 404/25
5,070,712 A 12/1991 Fox ..... 70/18
5,328,291 A 7/1994 Wisniewski ..... 404/2
5,727,351 A 3/1998 Neathery et al. ..... 52/20
5,827,007 A 10/1998 Barton et al. ..... 404/25
5,951,200 A 9/1999 Barton ..... 404/25
5,957,618 A 9/1999 Sims et al. ..... 404/25
5,966,876 A 10/1999 Neathery et al. ..... 52/20
6,212,919 B1 4/2001 Gerow ..... 70/18

* cited by examiner

*Primary Examiner*—Raymond W Addie
(74) *Attorney, Agent, or Firm*—John M. Harrison

(57) ABSTRACT

A watertight manhole insert and tether locking apparatus and method of use designed to prevent unauthorized entry into a sanitary sewer or other closed drainage system through a manhole closed by a manhole cover. The manhole insert is located beneath the manhole cover and is connected to the manhole by a tether apparatus in the manhole to prevent water entry into the manhole, theft of the manhole insert and to deny access to the manhole. The manhole insert includes a pan-shaped insert body having pressure-relief valve and a lift strap and a side wall fitted with a top rim for engaging a shoulder shaped in the manhole, to support the manhole insert in the manhole. In a preferred embodiment one end of a flexible stainless steel tether is connected to the bottom side of the manhole insert and the opposite end extends through a pair of oppositely-disposed anchor rings fixed to the manhole wall beneath the manhole insert and then through an opening in the manhole insert and a locking device on the top of the manhole insert. When the manhole insert is placed in the manhole, the tether is tightened in the anchor rings as it is pulled upwardly through the locking device and is locked at the locking device.

18 Claims, 4 Drawing Sheets

MANHOLE INSERT AND TETHER LOCKING APPARATUS AND METHOD

CROSS-REFERENCE TO RELATED APPLICATIONS

This application claims the benefit of and incorporates by reference prior filed copending U.S. Provisional Application Ser. No. 60/818,429, Filed Jul. 3, 2006.

SUMMARY OF THE INVENTION

This invention relates to manholes in sewer and other closed drainage systems and more particularly, to a substantially watertight manhole insert and tether locking apparatus which is designed to seal and lock the manhole immediately beneath a manhole cover and prevent flooding of the subterranean systems and unauthorized entry into the manhole. In one embodiment of the invention the manhole insert is characterized by a stainless steel, cylindrical, pan-shaped insert body having a rounded, ribbed or flat insert bottom provided with one or more pressure relief valves and connected to a tether system for securing the insert body in the manhole. The insert body has an upward-standing, sloping or perpendicular side or wall extending from the insert bottom and terminated by an outwardly-projecting rim adapted for seating on a shoulder formed in the manhole beneath the manhole cover. The outwardly-extending rim may be seated directly on the manhole shoulder or on a seal or gasket to minimize the flow of water, sediment and contaminants from ground level around the manhole cover and through the manhole, into the sewer or closed drainage system.

The top surface of the insert bottom is fitted with a locking device that receives one end of the flexible, stainless steel tether extending from above the insert through an opening in the insert bottom and in one embodiment of the invention, the opposite end of the tether is typically extended through a pair of spaced-apart anchor rings secured in the manhole wall beneath the manhole insert and terminates in attachment to the insert bottom. Both ends of a lift strap or straps may be attached to the insert bottom opposite or adjacent to the tether, or both, typically by means of a rivet, in a fixed or breakaway design to facilitate lifting and removing the manhole insert from a mounted position in the manhole throughout the length of the unlocked tether. In a typical embodiment of the invention the tether is secured in the manhole insert by a locking device as follows: the tether is threaded from above the insert through top and bottom openings in a lock housing welded to the insert and then through a tether opening provided in the insert bottom at the lock housing. The tether also extends through a loosened compression fitting located inside the lock housing between the two housing openings. Opposite sides of the lock housing are vertically slotted to receive a lock tab that selectively closes the only open end of the lock housing and blocks access to the compression fitting when the lock tab is inserted in the parallel, spaced-apart slots. One end of the lock tab has a pair of leg flanges that seats against the lock housing when the lock tab is fully inserted in the slots and an opening is provided in the opposite end of the lock tab for receiving a barrel lock. Accordingly, the lock housing, lock tab and barrel lock elements together constitute a locking device for immobilizing the tether and securing the manhole insert in the manhole, as hereinafter described. The opposite end of the tether is secured in the manhole below the manhole insert, typically as further hereinafter described.

In one embodiment of the invention, after the manhole insert has been placed in the manhole, the tether is tightened through a pair of spaced-apart anchor rings located in the manhole wall and pulled upwardly through the loosened compression fitting provided in the lock housing and fixed to the manhole insert bottom. The compression fitting is then tightened on the tether using a wrench which is inserted in the open end of the lock housing to maintain tension in the tether. The lock tab element of the locking device is slipped through the aligned housing slots and subsequently locked in place using the barrel lock, to securely seat the manhole insert uniformly and tightly against the manhole shoulder or against a seal or gasket positioned between the manhole insert rim and the manhole shoulder. Since the tether is effectively locked above the manhole insert and typically extends through the two, preferably diametrically-opposed, anchor rings fixed in the manhole wall and is secured to the bottom of the manhole insert, the manhole insert cannot be tipped or otherwise dislodged or removed from the manhole shoulder. Alternatively, the end of the tether extending into the manhole may be fixed to a single anchor point in the manhole wall to prevent theft of the manhole insert. A pressure relief valve installed in the insert bottom is designed to relieve pressure which may be generated in the subterranean system served by the manhole and also operates to relieve any vacuum which may develop in the drainage system.

The manhole insert locking system of this invention solves the problem of unauthorized entry into connected subterranean tunnels and systems by children and adults for various purposes. Sewer lines and tunnels may contain toxic and/or flammable gases, low oxygen, liquid contaminants and like hazards. Furthermore, sudden rainstorms can quickly flood these systems and due to the extensive network of pipes, channels and tunnels in such a system, people can easily become lost in the underground labyrinth. The locking device also serves as a defense against terrorist activities, including placement of explosives in underground drainage and sewer systems.

Accordingly, the invention provides a manhole insert and tether locking apparatus and a method for sealing and preventing unauthorized access into closed sewer and drainage systems, which includes the use of a molded, stamped, pressed or otherwise formed, rounded, ribbed or flat-bottomed stainless steel insert provided with one or more pressure and/or vacuum relief valves and an upward-standing, sloping or perpendicular side wall, terminated by an outwardly-projecting rim for seating on a ledge provided in a manhole beneath the manhole cover. The lock housing/compression fitting/lock tab/barrel lock tether locking device provides a simple, secure and positive defense against unauthorized entry into a manhole and the connecting tunnels.

BRIEF DESCRIPTION OF THE DRAWINGS

The invention will be better understood by reference to the accompanying drawings, wherein.

DESCRIPTION OF THE PREFERRED EMBODIMENTS

Figure 1:
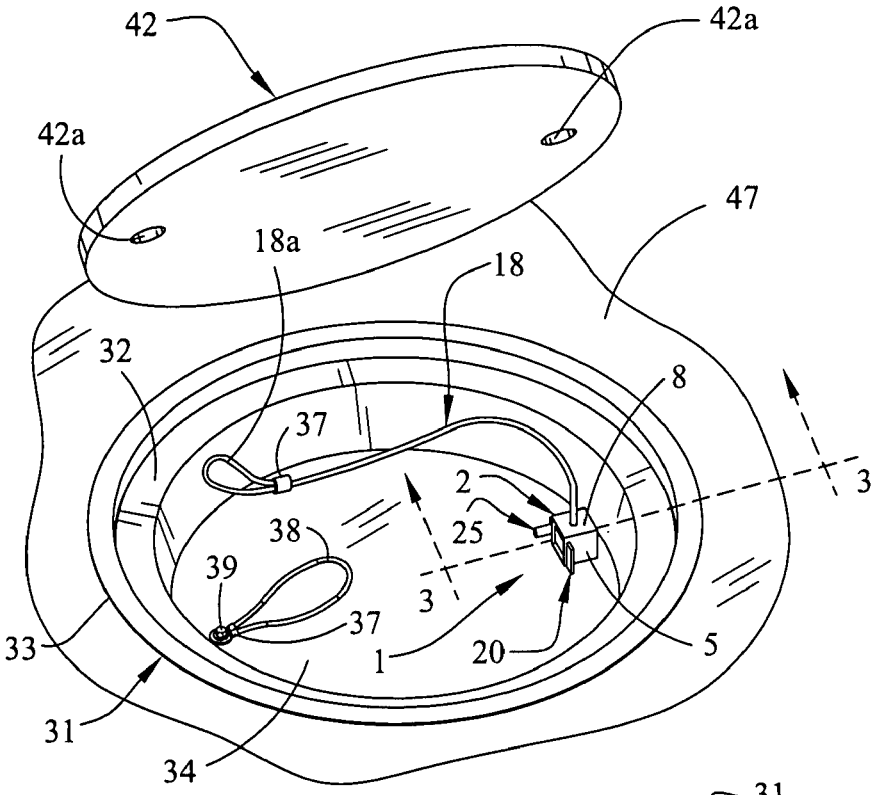
FIG. 1 is a perspective view of one embodiment of the manhole insert and tether locking apparatus of this invention, with the manhole insert illustrated in functional position seated in a manhole beneath a manhole cover and secured in the manhole by a tether apparatus and locking device.
Figure 2:
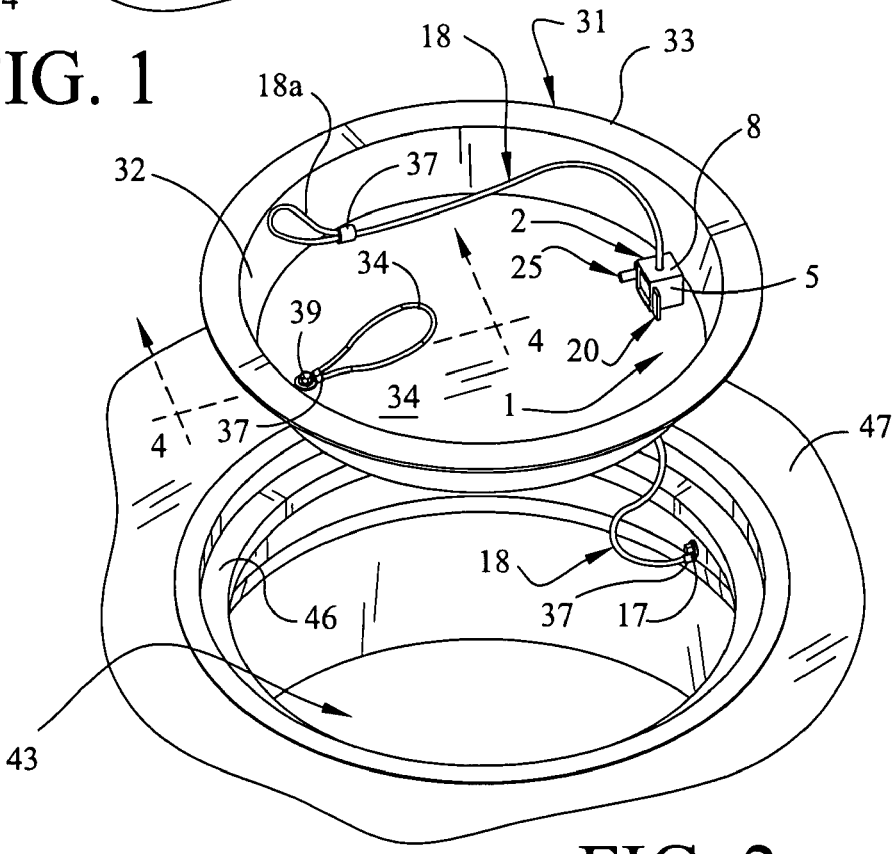
FIG. 2 is a perspective view of the manhole insert and tether cable elements of the tether apparatus illustrated in FIG. 1, with the manhole insert extended upwardly from the manhole and the locking device illustrated in tether-release configuration.
Figure 3:
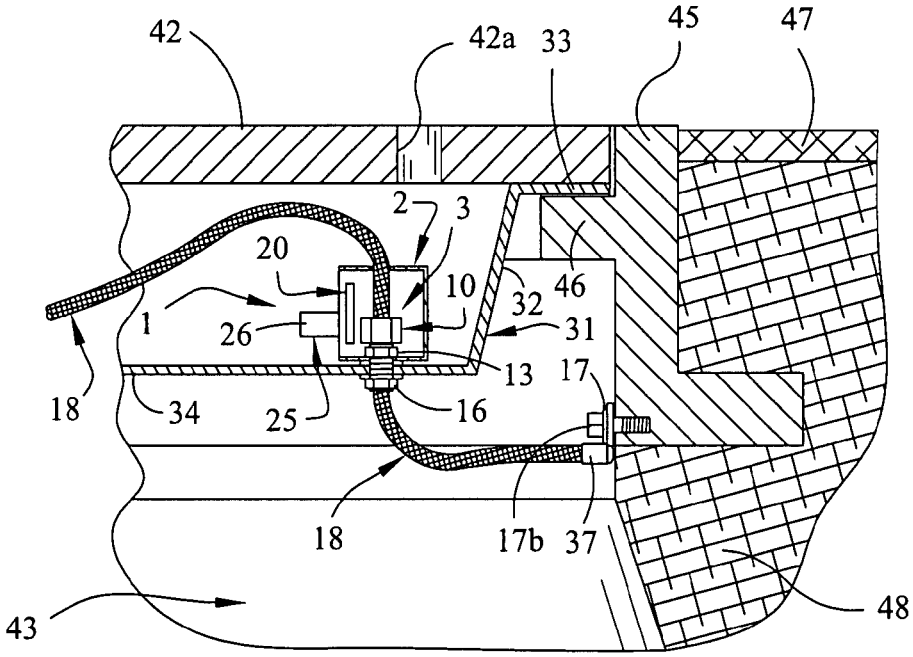
FIG. 3 is a sectional view of one segment of the manhole insert and the locking device and tether positioned in the manhole as illustrated in FIG. 1.

Referring initially to FIGS. 1-8 of the drawings, in a first embodiment the manhole insert and tether locking apparatus of this invention is generally illustrated by reference numeral 1. The manhole insert element is characterized by a dish or pan-shaped manhole insert 31, including a substantially flat or slightly rounded insert bottom 34, having a smooth bottom surface which terminates in a circular, upward-standing insert wall 32. The insert wall 32 may be substantially perpendicular with respect to the insert bottom 34, or disposed at an angle and sloped with respect to the insert bottom 34, as desired. A wall flange or rim 33 projects substantially horizontally outwardly from the top edge of the insert wall 32 and seats on a manhole shoulder 46 provided in the manhole structure 48 beneath the manhole cover 42 (FIG. 1) and the street paving 47 in a manhole 43, as illustrated in FIG. 3 and hereinafter described. The manhole insert 31 is typically shaped from stainless steel or molded from a suitable fiberglass or plastic material. Alternatively, the manhole insert 31 can be stamped, pressed, cast or otherwise formed from other suitable metals such as aluminum, in non-exclusive particular. As further illustrated in FIGS. 6 and 7, a pressure relief valve 41 (FIG. 7) is seated in a valve opening 35 (FIG. 6) provided in the insert bottom 34. The pressure relief valve 41 is designed to release pressure which may build up in the manhole 43 and connected subterranean drainage or sewer system (not illustrated).

Figure 9:
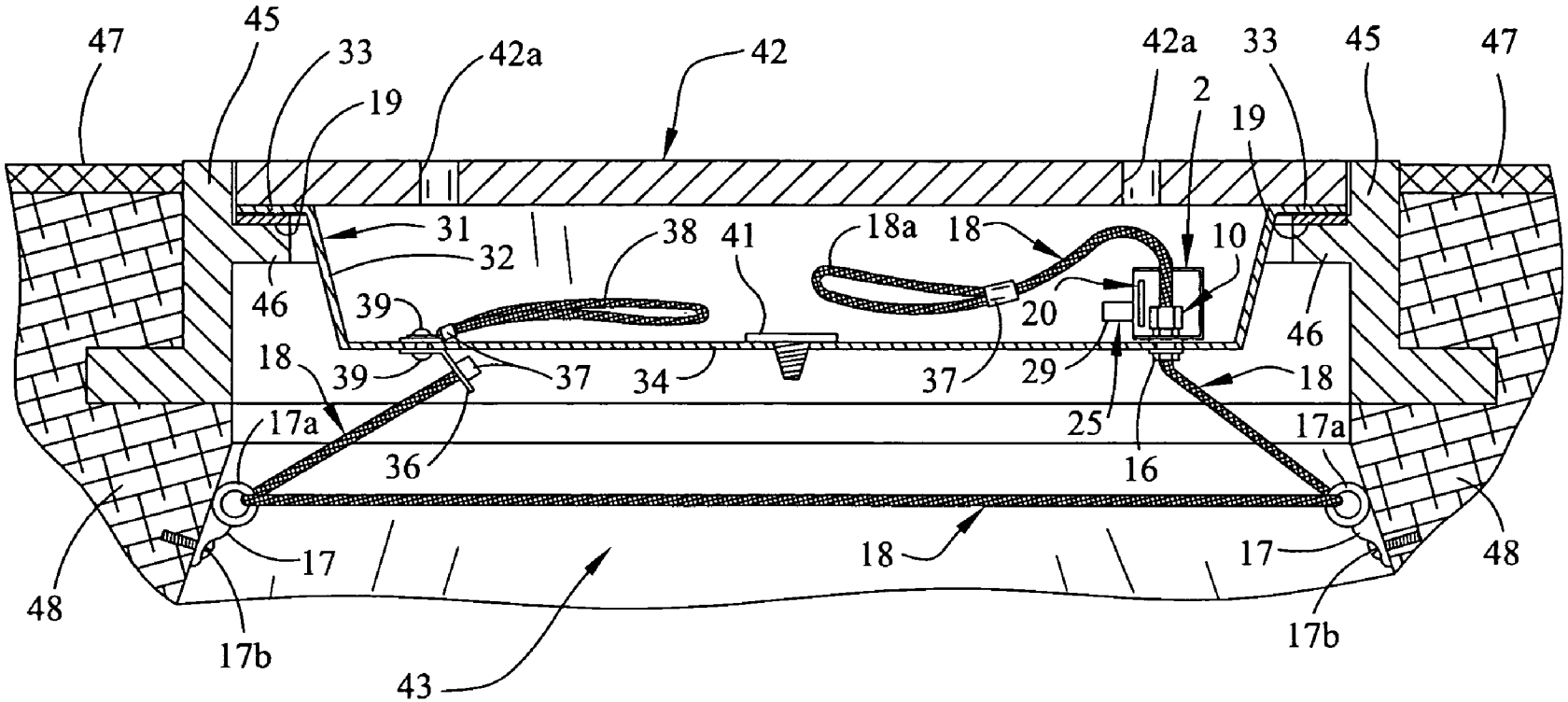
FIG. 9 is a sectional view of a second embodiment of the manhole insert and tether apparatus of this invention.

The manhole insert 31 is typically mounted in the manhole 43 with the rim 33 engaging the manhole shoulder 46 located in the manhole structure 44 (FIG. 3) or a seal or gasket 19, as illustrated in FIG. 9. The typically nitrile, neoprene or alternative gasket or seal 19 may be fitted under the rim 33, lying adjacent to and resting on the manhole shoulder 46 of the manhole structure 48, as further illustrated in FIG. 9. The ends of a lift strap 38 are typically fitted with a cable stay 37 and secured to the insert bottom 34 by means of a lift strap rivet 39 (FIGS. 1 and 2). The lift strap rivet 39 may be constructed of a soft metal such as aluminum and/or is sized to fail when a preselected force is applied to the lift strap 38 to prevent displacement of any part of the manhole insert 31 from the manhole shoulder 46 when the manhole insert 41 is locked on the manhole shoulder 46 as hereinafter described. Alternatively, the lift strap rivet 39 may be constructed of a stronger metal such as stainless steel, the head of which may be pulled through the insert bottom 34 of the manhole insert 31, responsive to the aforesaid preselected force. A length of flexible stainless steel cable is typically shaped to define the lift strap 38 and a tether loop 18*a* may also be shaped in the extending end of the longer tether 18 (FIG. 1), typically by means of a stainless steel cable stay 37.

Figure 4:
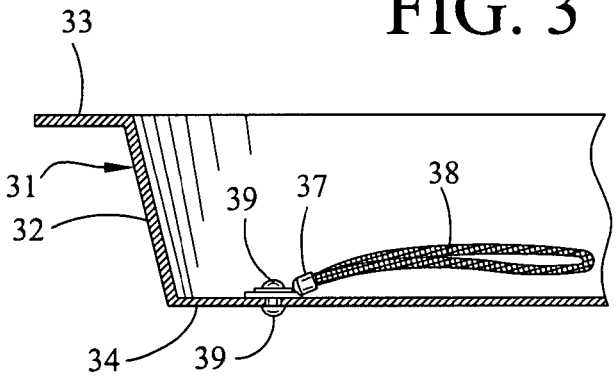
FIG. 4 is a sectional view of one segment of the manhole insert and a lift strap attached to the manhole insert, as illustrated in FIG. 1.
Figure 8:
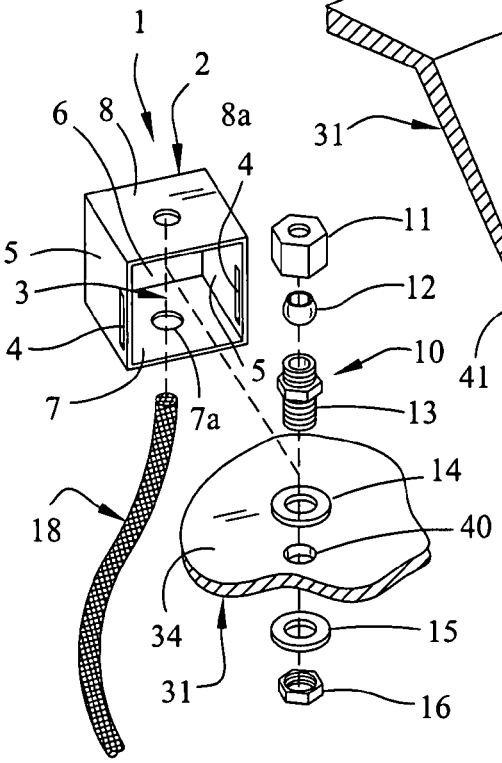
FIG. 8 is an exploded view of the locking device illustrated in FIGS. 1-3 and 5-7.

In the embodiment of the invention illustrated in FIGS. 3, 4 and 8, the opposite end of the tether 18 from the tether loop 18*a* is threaded through a top opening 8*a* and a bottom opening 7*a* in a lock housing 2 and through a compression fitting 10 to a bolt anchor 17, secured to the manhole wall 45 of the manhole 43. A cable stay 37 is typically used to secure the fixed end of the tether 18 to the bolt anchor 17. In this embodiment the primary function of the tether 18 and lock system, including the lock housing 2, the compression fitting 10, the lock tab 20 and the barrel lock 25, is to prevent theft of the manhole insert 31. In another embodiment of the invention the opposite end of the tether 18 is threaded through the lock housing 2 and the compression fitting 10 as described above and then through a pair of anchor rings 17*a*, mounted in the manhole wall 45, preferable at diametrically opposite points, by means of bolt anchors 17, as illustrated in FIG. 9 of the drawings. This end of the tether 18 is typically fitted with a cable stay 37 and is inserted in a slotted bracket 36, typically fixed to the insert bottom 34 by a lift strap rivet 39. The bolt anchors 17 are typically mounted in conventional fashion in holes drilled across the diameter (diametrically) in the manhole wall 45 of the manhole structure 48, as further detailed in FIG. 9. Alternatively, the fixed end of the tether 18 may be secured to any desired chemical-resistant mounting anchor such as eye bolts and the like, which can be anchored to the manhole wall 45, according to the knowledge of those skilled in the art. This locking configuration is designed not only to prevent theft of the manhole insert 31, but also to prevent tipping or displacement of the manhole insert 31 from the manhole shoulder 46 and unauthorized entry into the manhole 43, as hereinafter further described.

Figure 5:
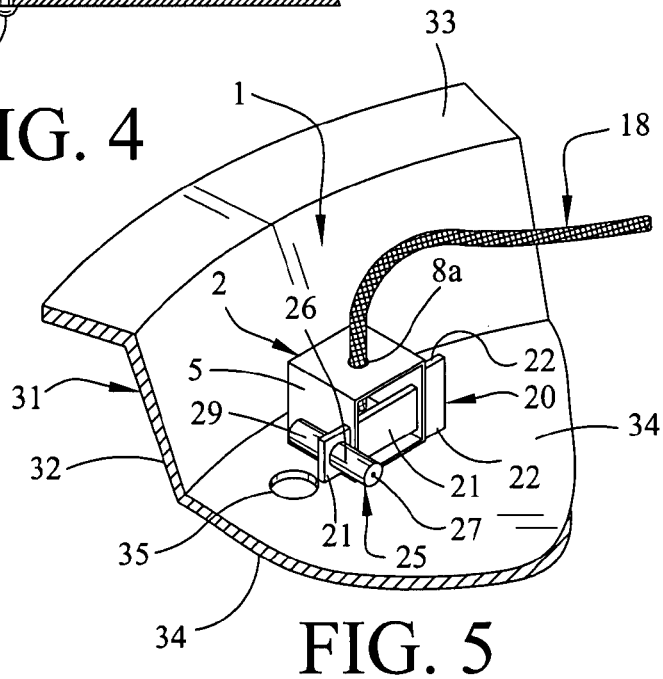
FIG. 5 is a perspective view of the locking device illustrated in FIGS. 1-3 in locked configuration in the manhole insert.
Figure 6:
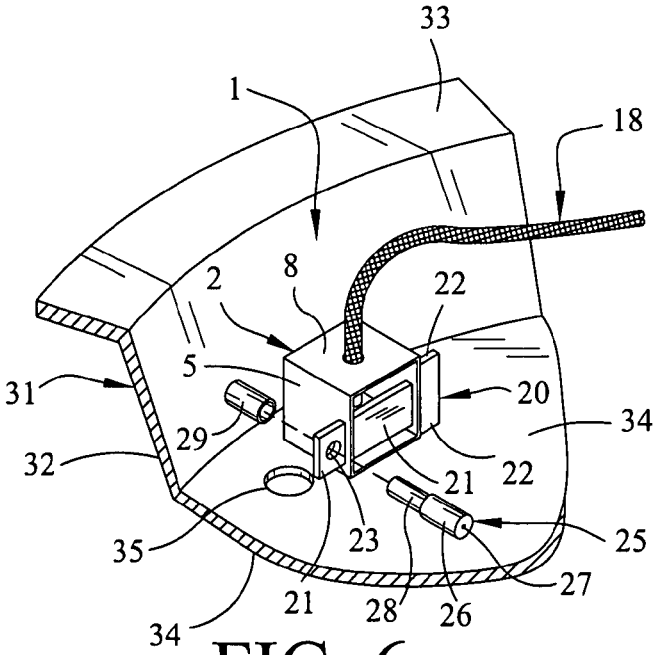
FIG. 6 is a partially exploded view of the locking device illustrated in FIG. 4, more particularly illustrating operation of the barrel lock element.
Figure 7:
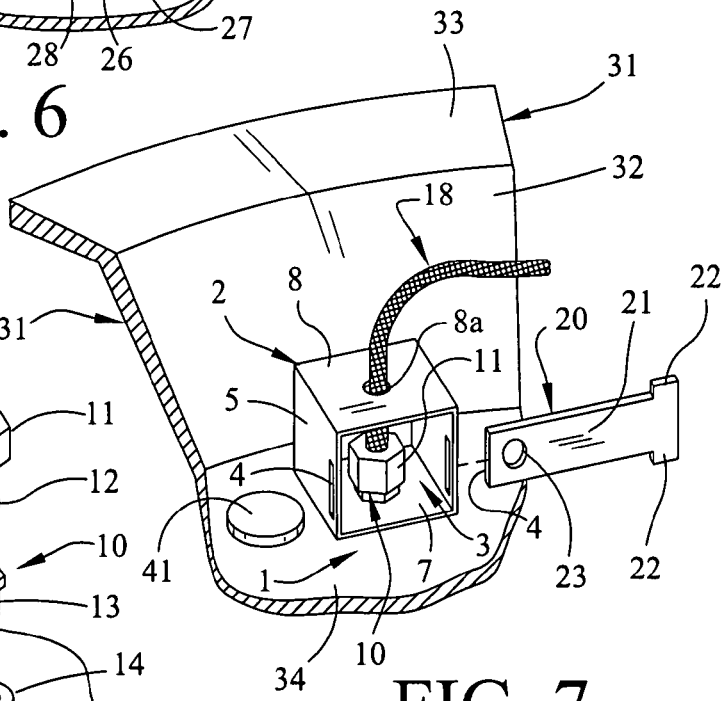
FIG. 7 is a partially exploded view of the locking device illustrated in FIGS. 5 and 6, more particularly illustrating removal of the lock tab from the lock housing to access the compression fitting in the lock housing and secure or release the tether.

Referring now to FIGS. 3 and 6-9 of the drawings, in both embodiments of the invention the lock housing 2 is typically welded to the insert bottom 34 of the manhole insert 31 and the compression fitting 10 engages that portion of the tether 18 extending through the tether opening 40 (FIG. 8) in the insert bottom 34, for securely seating and locking the manhole insert 31 in the manhole 43, as hereinafter described. As illustrated in FIGS. 6-8, in a preferred embodiment the locking device includes a lock housing 2, characterized by parallel side walls 5, an adjoining rear wall 6, a bottom 7, fitted with a bottom opening 7*a*, and a top 8, having a top opening 8*a* located opposite and aligned with the bottom opening 7*a* (FIG. 8). The housing interior 3 is accessed by an open front area of the lock housing 2 and a compression fitting 10 is placed in the housing interior 3 and is secured to the insert bottom 34. Oppositely-disposed and aligned vertical housing slots 4 are provided in the side walls 5 adjacent to this open front area to accommodate the elongated tab leg 21 of a lock tab 20, as further illustrated in FIGS. 6 and 7. One end of the tab leg 21 is fitted with leg flanges 22 to prevent the tab leg 21 from moving completely through the first of the housing slots 4 into which it is inserted. The opposite end segment of the tab leg 21 is provided with a typically round tab leg opening 23 for receiving the engaging cylinder 28 element of a typically conventional barrel lock 25 (FIG. 6). The engaging cylinder 28 extends from a key cylinder 26 having a key opening 27 therein, and a locking cylinder 29 removably engages the projecting end of the engaging cylinder 28, responsive to operation of a key (not illustrated) that is inserted in the key opening 27. Accordingly, it will be appreciated from a consideration of FIGS. 5-7 of the drawings that the lock tab 20 can be selectively used to block wrench-access into the housing interior 3 of the lock housing 2 and the compression fitting 10, using the barrel lock 25, as illustrated in the drawings and hereinafter further described.

Referring again to FIG. 8 of the drawings, the compression fitting 10 serves to selectively loosen and immobilize the tether 18 in the insert bottom 34. A wrench of suitable design and size (not illustrated) is used to tighten the compression nut 11 on the top end of the compression nipple 13, such that the internal seal washer 12 is tightened against the tether 18 and the compression nipple 13. The compression nipple 13 is tightly seated in the tether opening 40 in the insert bottom 34 using an inside washer 14, an outside washer 15 and a bottom nut 16, as further illustrated in FIG. 8. A wrench can be easily inserted in the open front of the lock housing 2 when the lock tab 20 is not in locking configuration in the housing slots 4 (FIG. 7).

In operation, the manhole insert 31 is mounted in functional position in the manhole structure 48 by seating the rim 33 on the manhole shoulder 46, located in the manhole 43 below the street paving 47, or on a gasket 19, as illustrated in FIG. 9, respectively. The tether 18 is tightened in the respective anchor rings 17*a* (FIG. 9) or against the bolt anchor 17 and anchor bolt 17*b* (FIG. 3) and pulled upwardly through the loosened compression fitting 10 and the lock housing 2, in a desired degree of tension. The loosened compression nut 11 is then tightened on the compression nipple 13 using a wrench (not illustrated) which is extended into the now open housing interior 3 of the lock housing 2 (FIG. 7). The tab leg 21 of the lock tab 20 is then inserted through the parallel housing slots 4 to block access to the housing interior 3 and the tightened compression fitting 10, and secure the tether 18 in tension inside the lock housing 2 (FIG. 6). The engaging cylinder 28 of the barrel lock 25 is then inserted in the tab leg opening 23 and the locking cylinder 29 is locked onto the engaging cylinder 28 to secure the lock tab 20 in place on the lock housing 2 (FIGS. 5 and 6). Accordingly, the manhole insert 31 cannot be tilted or removed from the manhole 43 by gripping either the tether loop 18*a* of the tether 18 or the selectively breakaway lift strap 38, due to the tension in the tether 18.

Although the manhole insert 31 illustrated in FIGS. 1 and 2 can be tipped due to the single point of fixture of the tether 18, it cannot be removed from the manhole 43. And the manhole insert 31 cannot be either tipped, displaced or removed from the manhole 43 when anchored as illustrated in FIG. 9, due to the oppositely-disposed mount points of the tether 18 in the manhole 43. This expedient effectively denies access to the underlying manhole 43, even when the conventional manhole cover 42 is removed, typically using a tool for insertion in the cover openings 42*a* (FIG. 1). As heretofore described, a predetermined excessive force applied to the lift strap 38 and the connected rivet of selected tensile strength will simply pull the lift strap rivet 39 through the insert bottom 34 before the tether 18 is broken, thus providing another safety feature to prevent compromising of the tether locking system.

It will be appreciated that the barrel lock 25 can be easily unlocked, the lock tab 20 removed from the housing slots 4, the compression fitting 10 loosened and the manhole insert 31 then lifted from the functional position in the manhole 43 to the full length of the tether 18, as illustrated in FIG. 2, when the conventional manhole cover 42 is moved from the manhole 43. This tether lock and release expedient prevents theft of the manhole insert 31 and unauthorized entry into the manhole 43, yet allows removal of the manhole insert 31 from the manhole 43 for repair work in the manhole 43 and connecting subterranean system.

It will be further appreciated that while the manhole insert 31 can be configured from molded synthetic polymeric materials such as polyethylene, polypropylene and acrylonitrile-butadiene-styrene (commonly called ABS) as well as fiberglass products and metals such as aluminum and steel, in non-exclusive particular, stainless steel is a preferred material of construction. Furthermore, the insert bottom 2 can be flat or rounded as illustrated in FIG. 1 or it can be ribbed, as detailed in my U.S. Pat. No. 4,919,564. Moreover, in a most preferred embodiment of the invention, the pressure relief valve 41, mounted in the insert bottom 34, is designed to relieve manhole pressure in a pressure range of from about 0.5 psi to about 1.6 psi.

It will also be appreciated by those skilled in the art that the manhole insert and tether lock of this invention is characterized by convenience and flexibility and operates to stop the flow of water, sediment and contaminants into sewer systems, control manhole odors, prevent dirt and trash from accumulating in the manhole and the sewer system and helps to prevent manhole rattling and "flipping" due to street traffic. The tether 18 allows removal of the manhole insert 31 from the manhole 43 to provide access to the manhole 43, while preventing theft or other removal of the manhole insert 31 from the area of the manhole 22, as illustrated in FIG. 1. The tether 18 can also be configured and designed to secure the manhole insert 31 in functional position in the manhole 43, as illustrated in FIG. 9 by initially unlocking the locking device to facilitate sliding the tether 18 through the locking device and tightening that segment of the tether 18 extending through the anchor rings 17*a*. The manhole insert 31 is thusly secured in the manhole 43, as heretofore described. The manhole insert 31 is then seated and maintained in position on the manhole shoulder 46 in a manhole 43, with or without the gasket 19, without the hazard of dropping from that position into the manhole 43, or the sewer or closed drainage system underlying the manhole 43 and without the hazard of theft, tipping of the manhole insert 31 and unauthorized entry into the manhole 43.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. In a manhole insert and tether apparatus having an insert body for seating in a manhole and having a tether opening, at least one tether-engaging member in the manhole wall, a tether having one end slidably extending through said tether opening and fixed to said tether engaging member and the opposite end of the tether extending above the insert body, wherein the improvement comprises a tether lock housing provided on the insert body at the tether opening; a compression fitting provided in said tether lock housing for slidably receiving the opposite end of the tether and selectively tightly securing the tether in said tether lock housing; a lock tab slidably fitted in said tether lock housing for selectively blocking access to said compression fitting and a lock removably engaging said lock tab for removably securing said lock tab on said tether lock housing and securing the insert body in the manhole.

2. The manhole insert and tether apparatus of claim 1 comprising a bracket mounted on said insert bottom and wherein said opposite end of said tether slidably engages said tether engaging member and is connected to said bracket.

3. The manhole insert and tether apparatus of claim 1 comprising a gasket for engaging the manhole wall and said rim for sealing said insert body in the manhole.

4. The manhole insert and tether apparatus of claim 1 wherein said tether lock housing is fixed to said insert body at the tether opening and said compression fitting is seated in said lock housing for receiving said tether and selectively immobilizing said tether in said tether lock housing.

5. The manhole insert and tether apparatus of claim 3 wherein said insert body comprises an insert bottom, a continuous side wall upward-standing from said insert bottom and a rim shaped in said side wall for supporting said insert body in the manhole and comprising at least one lift strap attached to said insert bottom for lifting said insert body from the manhole when the manhole cover is removed.

6. The manhole insert and tether apparatus of claim 5 comprising a pressure relief valve provided in said insert bottom for relieving pressure in the manhole.

7. The manhole insert and tether apparatus of claim 5 comprising a rivet having a preselected tensile strength connecting said at least one braided cable lift strap to said insert body.

8. The manhole insert and tether apparatus of claim 5 comprising a gasket for engaging the manhole wall and said rim and sealing said insert body in the manhole.

9. The manhole insert and tether apparatus of claim 5 comprising a slotted bracket mounted on said insert bottom and wherein said opposite end of said tether engages said tether engaging member and is removably connected to said slotted bracket.

10. The manhole insert and tether apparatus of claim 9 comprising a pressure relief valve provided in said insert bottom for relieving pressure in the manhole.

11. The manhole insert and tether apparatus of claim 5 comprising a slotted bracket positioned adjacent to said insert bottom and wherein said at least one tether-engaging member comprises a pair of spaced-apart tether engaging members and said opposite end of said tether is removably connected to said slotted bracket and slidably engages said engaging members and comprising a fastener connecting said slotted bracket to said insert bottom.

12. The manhole insert and tether apparatus of claim 11 comprising a gasket for engaging the manhole wall and said rim and sealing said insert body in the manhole and a pressure relief valve provided in said insert bottom for relieving pressure in the manhole.

13. A tether locking device for a manhole insert having a generally pan-shaped insert body, an insert bottom having a tether opening and terminated by an upward-standing continuous side wall having a top edge for seating in manhole having a manhole wall and a manhole shoulder, at least one pressure relief valve extending through the insert bottom for releasing pressure in the manhole, a rim shaped in the top edge of the side wall for engaging the shoulder of the manhole and supporting the insert body on the shoulder, a pair of spaced-apart tether mount devices fixedly attached to the manhole wall, a flexible tether of selected length having one end extending through the tether opening in the insert bottom and the opposite end of the tether extending through the tether mount devices and attached to the insert bottom in spaced-apart relationship with respect to the tether opening, said tether locking device comprising a compression fitting mounted on said insert bottom of said insert body for slidably receiving said tether and selectively tightening on said tether and securing said insert body in the manhole, a lock housing fixed to said insert bottom and enclosing said compression fitting, a lock tab slidably engaging said lock housing for selectively blocking access to said compression fitting and a lock for removably engaging the lock tab and preventing the removal of the lock tab and selectively locking said tether in said lock housing.

14. The manhole insert and tether apparatus of claim 13 comprising a slotted bracket mounted on said insert bottom and wherein said opposite end of said tether is removably connected to said slotted bracket.

15. The manhole insert and tether apparatus of claim 13 comprising at least one lift strap and a rivet having a preselected tensile strength attached to said insert body and said lift strap for lifting said insert body from the manhole when said barrel lock is unlocked, said lock tab is removed from said lock housing, said compression fitting is loosened and said tether is slidably displaced in said compression fitting.

16. The manhole insert and tether apparatus of claim 15 comprising a gasket for engaging the manhole wall and said rim and sealing said insert body in the manhole and a slotted bracket mounted on said insert bottom and wherein said opposite end of said tether is connected to said slotted bracket.

17. A method for locking a manhole insert in a manhole beneath a manhole cover and preventing unauthorized entry into the manhole, comprising the steps of providing a manhole insert; providing an opening in the manhole insert; securing a pair of tether mount rings in the manhole in spaced-apart relationship with respect to each other, seating the manhole insert in the manhole; extending a flexible tether through the opening in the manhole insert and through the tether mount rings and securing one end of the flexible tether to said manhole insert; providing a lock housing on the manhole insert; locating a compression fitting in said lock housing for receiving the flexible tether; tightening the compression fitting on the flexible tether; closing the lock housing with a lock tab; and applying a barrel lock to the lock tab for selectively locking the lock tab in the lock housing and immobilizing the flexible tether in the compression fitting and the lock housing.

18. The method according to claim 17 which includes the step of attaching a lift strap to the manhole insert using a rivet having a preselected tensile strength.

* * * * *